US005413491A

United States Patent [19]

Noschese

[11] Patent Number: 5,413,491

[45] Date of Patent: May 9, 1995

[54] SMALL FORM FACTOR CONNECTORS WITH CENTER GROUND PLATE

[75] Inventor: Rocco J. Noschese, Wilton, Conn.

[73] Assignee: Burndy Corporation, Norwalk, Conn.

[21] Appl. No.: 135,678

[22] Filed: Oct. 13, 1993

[51] Int. Cl.[6] ..... H01R 4/66

[52] U.S. Cl. ..... 439/108; 439/98

[58] Field of Search ..... 439/98, 108

[56] References Cited

U.S. PATENT DOCUMENTS

| | | | |
|---|---|---|---|
| 4,602,832 | 7/1986 | Cunningham et al. | 339/14 R |
| 4,806,110 | 2/1989 | Lindeman | 439/108 |
| 4,824,384 | 4/1989 | Nicholas et al. | 439/108 |
| 4,932,888 | 6/1990 | Senor | 439/108 |
| 5,057,028 | 10/1991 | Lemke et al. | 439/108 X |
| 5,120,232 | 6/1992 | Korsunsky | 439/108 |
| 5,127,839 | 7/1992 | Korsunsky et al. | 439/108 X |
| 5,160,223 | 11/1992 | Carney | 439/108 |
| 5,161,987 | 11/1992 | Sinisi | 439/101 |
| 5,195,899 | 3/1993 | Yatsu et al. | 439/108 X |

*Primary Examiner*—Eugene F. Desmond
*Attorney, Agent, or Firm*—Perman & Green

[57] ABSTRACT

An electrical connector assembly is provided with a first connector and a mating second connector. The first connector has two rows of signal contacts and ground contacts located between the two rows of signal contacts. The second connector has two rows of mating signal contacts and a row of mating ground contacts between the two rows of mating signal contacts.

16 Claims, 3 Drawing Sheets

SMALL FORM FACTOR CONNECTORS WITH CENTER GROUND PLATE

BACKGROUND OF THE INVENTION

1. Field of the Invention

The present invention relates to electrical connectors and, more particularly, to connectors with a center grounding plane.

2. Prior Art

U.S. Pat. No. 4,805,110 discloses electrical connectors with central ground plates in two electrical connectors. U.S. Pat. No. 5,161,987 discloses two electrical connectors for connecting two parallel printed circuit boards to each other. The connectors include a center ground bus bar and a center receptacle bus bar with through-hole mounting posts. U.S. Pat. No. 5,120,232 discloses electrical connectors with printed circuit board surface mounting contacts and bus bars. U.S. Pat. Nos. 4,824,384; 4,932,888; 5,160,273; and 4,602,832 disclose other types of electrical connectors.

SUMMARY OF THE INVENTION

In accordance with one embodiment of the present invention an electrical connector assembly is provided comprising a first connector and a second connector. The first connector has a first housing, a plurality of first signal contacts, and a plurality of first ground contacts. The first signal contacts are aligned in at least two rows with the first ground contacts located between the two rows. The first ground contacts each comprise a plurality of through-hole mounting sections extending from the first housing and a plurality of opposing cantilever arms aligned in a row in a first receiving area of the first housing.

The second connector is connected to the first connector and has a second housing, a plurality of second signal contacts, and a plurality of second ground contacts. The second signal contacts are aligned in at least two rows and are electrically connected to the first signal contacts. The second ground contacts each comprise a plurality of through-hole mounting sections extending from the second housing and a ground plate electrically connected to and located between the opposing arms of at least one of the first ground contacts.

In accordance with another embodiment of the present invention a printed circuit board assembly is providing comprising a first printed circuit board, a first electrical connector, a second electrical connector, and a second printed circuit board. The first printed circuit board has a first plurality of contact through-holes aligned in at least one row and two rows of surface mounting contact pads on opposite sides of the row of first through-holes. The first electrical connector has a first housing, first signal contacts and first ground contacts. The first signal contacts are aligned in two rows with tail ends being surface mounted to the surface mounting contact pads of the first printed circuit board. The first ground contacts each comprise a plurality of through-hole mounting sections located in the through-holes of the first printed circuit board and a plurality of opposing cantilever arms aligned in a row between the two rows of first signal contacts. The second electrical connector is removably connected to the first electrical connector and includes a second housing, second signal contacts, and second ground contacts. The second signal contacts are aligned in two rows and removably electrically connected to the first signal contacts. The second ground contacts each have through-hole mounting sections extending from the second housing and a ground plate electrically connected to and located between the opposing arms of the first ground contacts. The second printed circuit board is electrically and mechanically connected to the second connector with the through-hole mounting sections of the second ground contacts located in through-holes of the second printed circuit board.

In accordance with another embodiment of the present invention an electrical connector assembly is provided comprising a first electrical connector, a second electrical connector, and means for aligning. The first electrical connector comprises a first housing, first signal contacts, and first ground contacts. The signal contacts comprise two cantilever arms with opposing contact surfaces. The second electrical connector comprises a second housing, second signal contacts, and second ground contacts. The second signal contacts each comprise a pin section sandwiched between the opposing contact surfaces of one of the first signal contacts. The means for aligning can align the pin sections in a lateral center of their respective first signal contact opposing contact surfaces. The means for aligning comprises the first housing having first projections and recesses at opposite ends of the first housing matingly engaged with second projections and recesses at opposite ends of the second housing such that the two housings are precisely laterally aligned with each other.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
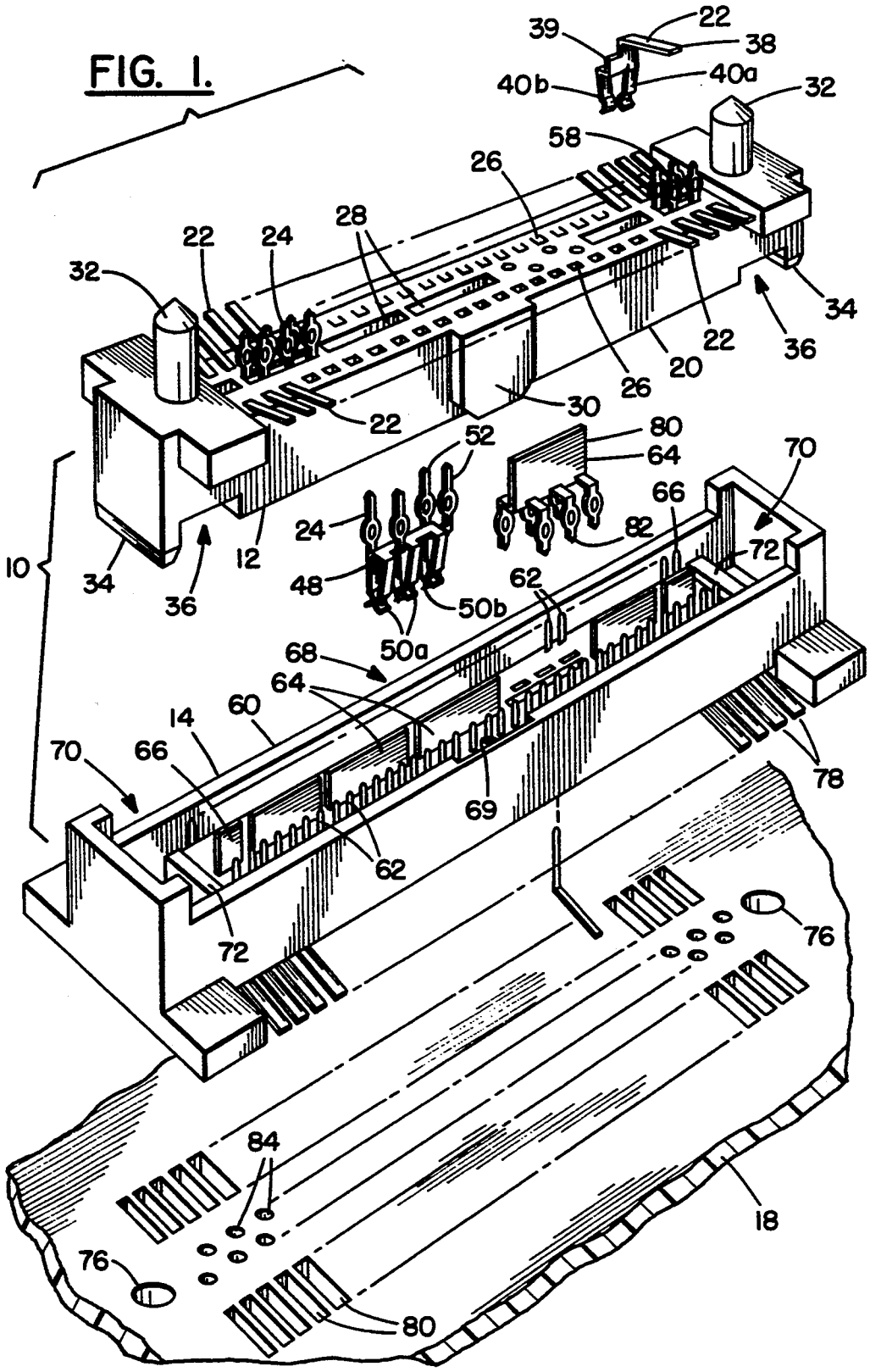
FIG. 1 is a partially exploded perspective view of a connector assembly incorporating features of the present invention.
Figure 2:
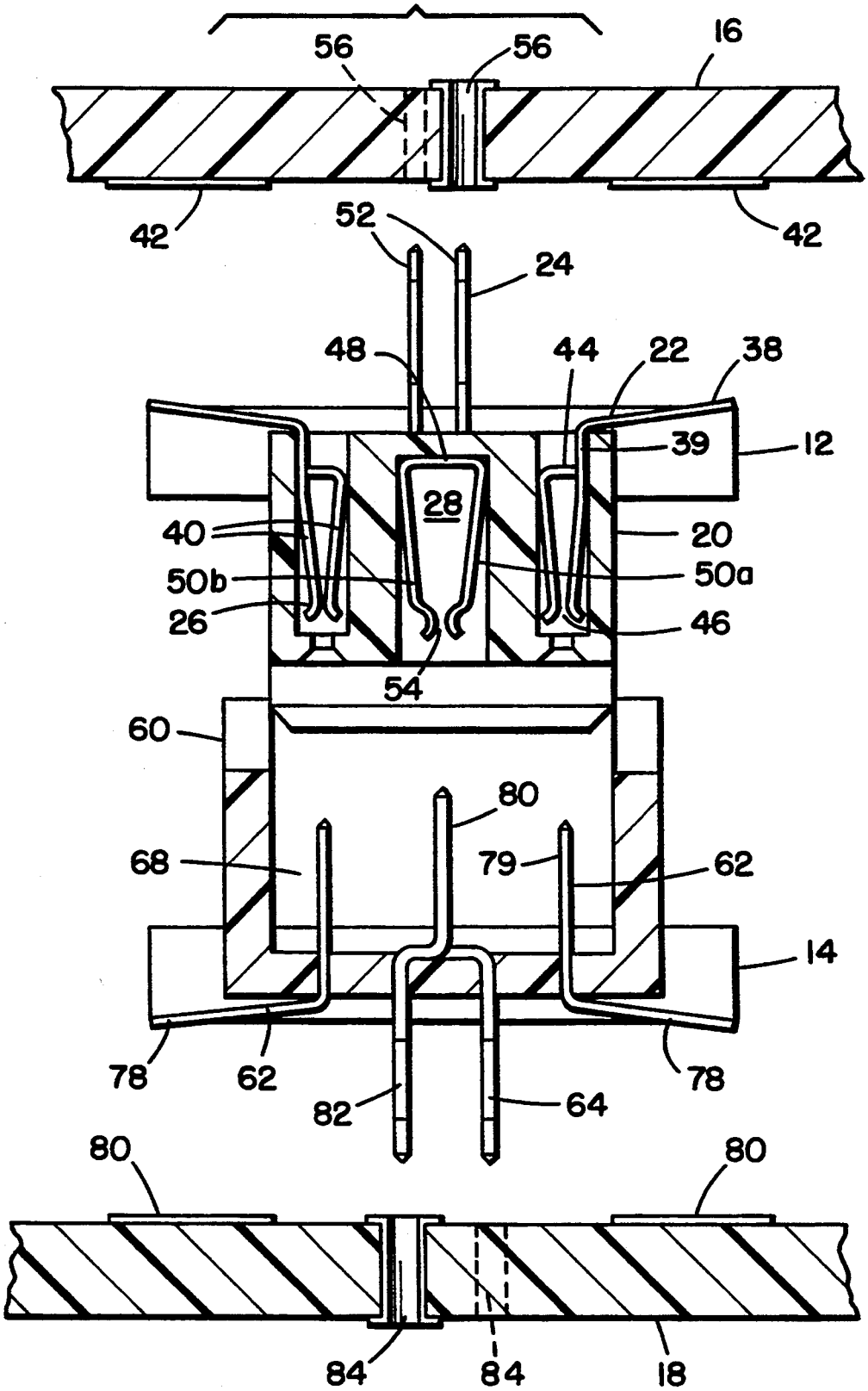
FIG. 2 is an exploded cross-sectional view of the assembly shown in FIG. 2 for connecting the two parallel printed circuit boards shown.

Referring to FIGS. 1 and 2, there is shown an electrical connector assembly 10 incorporating features of the present invention. Although the present invention will be described with reference to the single embodiment shown in the drawings, it should be understood that features of the present invention can be incorporated into various different forms of embodiments. In addition, any suitable size, shape or type of elements or materials could be used.

Figure 3A:
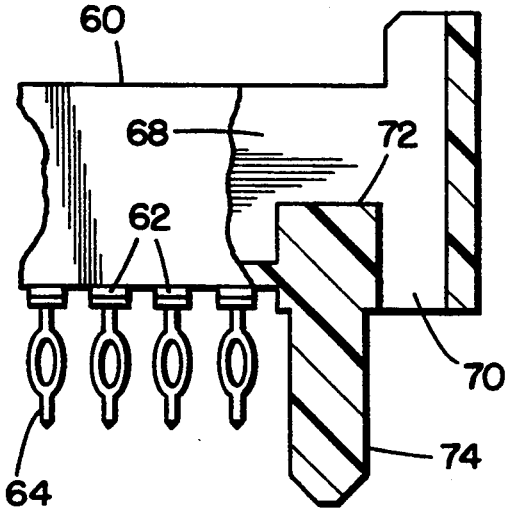
FIG. 3A is a cut-away view of one end of the bottom connector shown in FIGS. 1 and 2.
Figure 3B:
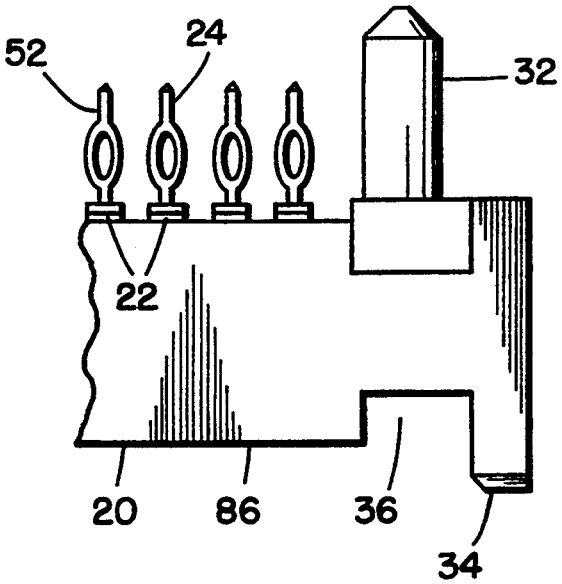
FIG. 3B is an elevational side view of one end of the top connector shown in FIGS. 1 and 2.

The assembly 10 generally comprises a first plug electrical connector 12 and a second socket electrical connector 14. The assembly 10 is adapted to removably electrically connect a first printed circuit board 16 with a second printed circuit board 18. However, in alternate embodiments and uses, the assembly could be adapted to removably electrically connect other type of electrical or electronic components. The first connector 12 includes a first housing 20, a plurality of first signal contacts 22, and a plurality of first ground contacts 24. The first housing 20 is made of a dielectric material, such as a molded polymer material. The housing 20 includes two rows of signal contact receiving slots 26 with a row of ground contact receiving slots 28 between the two rows. One side of the housing 20 has a polarizing projection 30. Two mounting posts 32 are provided to fixedly mechanically mount the housing 20 to the first board 16. Referring also to FIG. 3B, the longitudinal ends of the housing 20 have a projection 34 and a recess 36. In alternate embodiments, other suitable types of arrangements could be provided.

Figure 4:
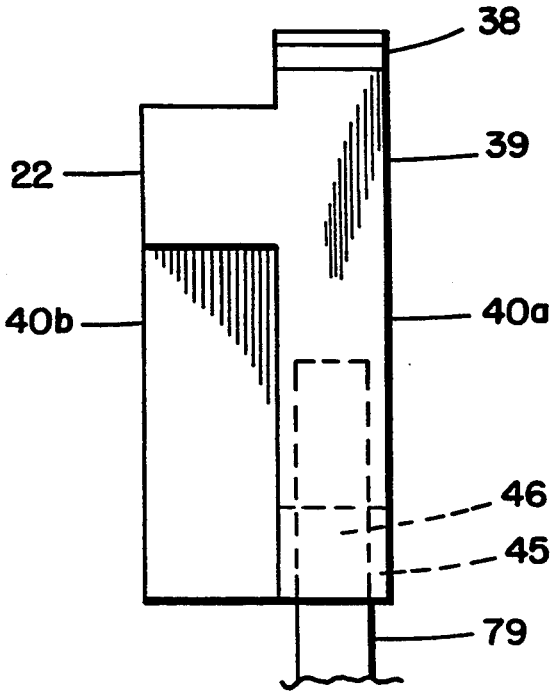
FIG. 4 is a diagrammatic side view of a female signal contact mated with a male signal contact.

The first signal contacts 22 are comprised of a flat sheet of metal that is cut and stamped to form the individual contacts 22. Each contact 22 has a tail end 38, a middle section 39, and two cantilevered spring contact arms 40*a* and 40*b* (collectively referred to as 40). In the embodiment shown, the tail end 38 is a surface mount solder tail that is adapted to be soldered onto contact pads 42 on the first board 16. However, in alternate embodiments, the tail ends 38 could have any suitable shape, such as for through-hold mounting to the first board 16. Referring also to FIG. 4, the first contact arm 40*a* extends down from the middle section 39. The second contact arm 40*b* extends from an offset section 44 of the middle section 39 at an angle towards the opposite first contact arm 40*a*. The end of the second arm 40*b* has an extention 45. The extention 45 and first arm 40*a* form a male contact receiving area 46 therebetween. The first signal contacts 22 are fixedly mounted in the two rows of signal contact receiving slots 26 with their solder tails 38 extending out of the slots 26 as shown. In alternate embodiments, other suitable types of signal contacts could be used.

The first ground contacts 24 are also comprised of a flat sheet of metal that is cut and deformed into the shape shown. Each ground contact 24 has a rectangular center section 48, pairs of cantilever arms 50*a* and 50*b* (collectively referred to as 50) extending from the center section 48, and a plurality of through-hole mounting sections 52 extending from the center section 48. The pairs of cantilever arms 50 extend from the center section 48 in a first direction from opposite sides of the middle section 48 to form a receiving area 54. The arms 50 are spring arms adapted to deflect outward as a male ground contact is inserted in area 54. The through-hole mounting sections 52 extend from the middle section 48 in an opposite second direction. As seen in FIG. 1, the center section 48 is aligned generally perpendicular to the mounting sections 52 and cantilever arms 50. The ground contacts 24 are fixedly mounted in the ground contact receiving slots 28 with the mounting sections 52 extending out of the first housing 20. The mounting sections 52 are adapted to be positioned in the holes 56 of the first board 16 and electrically connected to a ground on the first board.

In the embodiment shown, the first connector 12 also has two power contacts 58, only one of which is shown. Each power contact 58 is located at an opposite end of the housing 20. The power contacts 58 are substantially the same as the ground contacts 24, only shorter in length. In alternate embodiments, the power contacts need not be provided. In addition, in alternate embodiments, any suitable number of power and ground contacts could be provided along with any suitable shape or configuration.

The second connector 14 generally comprises a second housing 60, a plurality of second signal contacts 62, a plurality of second ground contacts 64, and two power contacts 66. The second housing 60 is comprised of dielectric material, such as molded polymer. The housing 60 has a receiving area 68 for receiving substantially the entire first housing 20 therein. A polarizing slot 69 is provided in one interior side of the second housing 60 to accommodate the polarizing projection 30 on the first housing 20. Referring also to FIG. 3A, the longitudinal ends of the second housing 60 have recesses 70 therethrough and a raised area 72. The second housing 60 also has mounting posts 74 (only one of which is shown) for fixedly connecting the housing 60 to the second printed circuit board 18 in holes 76.

The second signal contacts 62 are pin contacts fixedly connected to the second housing 60 in two parallel rows. The second signal contacts 62 have tail ends 78 that extend out of the housing 60 to form surface mounting solder tails. The solder tails 78 are adapted to be electrically connected to contact pads 80 on the second printed circuit board 18. Contact areas 79 of the second signal contacts 62 are located in the receiving area 68. However, in alternate embodiments, other suitable types of signal contacts could be provided.

The second ground contacts 64 are generally comprised of a sheet of metal that is cut and deformed to form the shape shown. The second ground contacts 64 each have a ground plate section 80 and a plurality of through-hole mounting sections 82 extending from opposite sides of the ground plate section 80. The mounting sections 82 extend from the second housing 60 and are adapted to be fixedly located in holes 84 in the second board 18 to electrically connect to a ground in the second board 18. The ground plate sections 80 are located in the receiving area 68 between the two row of second signal contacts 62.

The second power contacts 66 are provided at opposite ends of the second housing 66. The second power contacts 66 are substantially the same as the second ground contacts 64, only shorter in length. In alternate embodiments, the second power contacts need not be provided or, could have any suitably shape or configuration on the second housing 60. The second power contacts 66 are adapted to make electrical contact with a power conductor on the second board 18.

The first connector 12 is adapted to be plugged into the second connector 14 to electrically and mechanically connect the first and second printed circuit boards to each other. The leading edge 86 of the first connector 12 is inserted into the receiving area 68. The polarizing projection 30 is matingly received in the polarizing recess 69. This prevents the two connectors 12, 14 from being connected to each other in reverse orientations. The two projections 34 at the ends of the first connector 12 are received into the recesses 70 of the second connector 14. The two raised areas 72 of the second connector 14 are received into the recesses 36 of the first connector 12. As seen in FIG. 1, the two projections 34 at opposite outer ends of the first housing 20 extend the entire width of the first housing 20 and extend past the leading edge 86 of the rest of the first housing. The first recesses 36, as seen in FIGS. 1 and 3B, extend the entire width of the first housing 20 next to the first projections 34. The second projections 72, as seen in FIGS. 1 and 3A, are located in the receiving area 68 and extend the entire width of the receiving area. The interlocking nature of the two housings 20, 60 by means of the receiving area 68, recesses 36, 70, raised areas 72, and projections 34 insures a stationary and precise connection of the two connectors to each other. Precise dimensioning of the housings 20, 60, accomplished by the use of well known molding technology, allows this type of precise interlocking stationary connecting to be accomplished.

As the first connector 12 is inserted into the second connector 14, the mating contacts become connected to each other. The grounding plate sections 80 of the second ground contacts project into areas 54 to be captured between the opposing arms 50*a*, 50*b*, of the first ground contacts 48. This makes an electrical connection between the mating ground contacts 48, 64. The pin contact areas 79 of the second signal contacts 62 are inserted into receiving areas 46, as shown in FIG. 4, to be captured between the opposing first arm 40*a* and extention 45 of the second arm 40*b*. This makes an electrical connection between the mating signal contacts 22, 62. The precise mating of the housings 20, 60 insure that the pin contact areas 79 are precisely aligned in the receiving areas 46 to prevent misconnection. The power contacts 58, 66 are also electrically connected to each other similar to the ground contacts. It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector assembly comprising:

a first connector having a first housing, a plurality of first signal contacts, and a plurality of first ground contacts, the first signal contacts being aligned in at least two rows with the first ground contacts located between the at least two rows, the first ground contacts each comprising a plurality of through-hole mounting sections extending from the first housing, a plurality of opposing pairs of cantilever arms aligned in a row in a receiving area of the first housing, and a rectangular center section between the mounting sections and pairs of cantilever arms, the rectangular center section being aligned generally perpendicular to the mounting sections and the pairs of cantilever arms; and a second connector connected to the first connector having a second housing,a plurality of second signal contacts, and a plurality of second ground contacts, the second signal contacts being aligned in at least two rows and being electrically connected to the first signal contacts, the second ground contacts each comprising a plurality of through-hole mounting sections extending from the second housing and a ground plate electrically connected to and located between the opposing arms of at least one of the first ground contacts.

2. An assembly as in claim 1 wherein the first housing is substantially entirely located in a mating receiving area of the second housing.

3. An assembly as in claim 2 wherein the first and second housings include alignment means for precisely locating the first housing relative to the second housing.

4. An assembly as in claim 3 wherein the alignment means includes the first housing having projections at opposite ends of the first housing and the second housing having recesses at opposite ends of the second housing, the projections being matingly located in the recesses.

5. An assembly as in claim 4 wherein the first and second housings include polarizing means for allowing the first housing to be inserted into the second housing in only one orientation.

6. An assembly as in claim 1 wherein the first and second signal contacts comprise surface mount tail ends.

7. An assembly as in claim 1 wherein the first and second connectors include power contacts aligned with the ground contacts at opposite ends of the housings.

8. An assembly as in claim 1 wherein the pairs of the cantilever arms extend in a first direction from the center section, the arms of each pair of arms extending from opposite sides of the center section, and each pair of the pairs of arms having its own associated through-hole mounting section extending from an opposite second direction from the center section.

9. A printed circuit board assembly comprising:

a first printed circuit board having a first plurality of contact through-holes aligned in at least one row and two rows of surface mounting contact pads on opposite sides of the row of first through-holes;

a first electrical connector having a first housing, first signal contacts and first ground contacts, the first signal contacts being aligned in two rows with tail ends surface mounted to the surface mounting contact pads of the first printed circuit board, the first ground contacts each comprising a plurality of through-hole mounting sections located in the through-holes of the first printed circuit board and a plurality of opposing cantilever arms aligned in a row between the two rows of first signal contacts;

a second electrical connector removably connected to the first electrical connector, the second electrical connector having a second housing, second signal contacts and second ground contacts, the second signal contacts being aligned in two rows and removably electrically connected to the first signal contacts, the second ground contacts each having through-hole mounting sections extending from the second housing and a ground plate electrically connected to and located between the opposing arms of the first ground contacts, the first housing being substantially entirely located in a mating receiving area of the second housing; and a second printed circuit board electrically and mechanically connected to the second connector with the through-hole mounting sections of the second ground contacts located in through-holes of the second printed circuit board, the second signal contacts having tail ends surface mounted to surface mounting contact pads of the second printed circuit board.

10. An assembly as in claim 9 wherein the first and second housings include alignment means for precisely locating the first housing relative to the second housing, and the alignment means includes the first housing having projections at opposite ends of the first housing and the second housing recesses at opposite ends of the second housing, the projections being matingly located in the recesses.

11. An assembly as in claim 10 wherein the first housing has an offset projection along one of its longitudinal sides and the second housing has an offset recess along one of its longitudinal sides, the offset projection being located in the offset recess, the offset projection and offset recess preventing the first housing from being positioned in the mating receiving area of the second housing except in one orientation.

12. An assembly as in claim 9 wherein the first and second connectors include power contacts aligned with the ground contacts at opposite ends of the housings.

13. An assembly as in claim 9 wherein the first ground contacts each comprise a rectangular center section, pairs of the cantilever arms extending in a first direction from each of the center sections, the arms of each pair of arms extending from opposite sides of the center section, and each pair of the pairs of arms having its own associated through-hole mounting section extending from an opposite second direction from the center section.

14. An electrical connector assembly comprising:

a first electrical connector comprising a first housing, first signal contacts and first ground contacts, the first signal contacts each comprise two cantilever arms with opposing contact surfaces;

a second electrical connector comprising a second housing, second signal contacts and second ground contacts, the second signal contacts each comprising a pin section sandwiched between the opposing contact surfaces of one of the first signal contacts; and means for aligning the pin sections in a lateral center of their respective first signal contact opposing contact surfaces, the means for aligning comprising the first housing having first projections and recesses at opposite ends of the first housing matingly engaged with second projections and recesses at opposite ends of the second housing such that the two housings are precisely laterally aligned with each other, the first projections including two projections at opposite outer ends of the first housing that extend the width of the first housing and extend past a leading edge of the rest of the first housing, the first recesses including two recesses that extend the width of the first housing next to the first projections, and the second projections include two raised areas located in a receiving area of the second housing that extend the entire width of the receiving area.

15. An assembly as in claim 14 wherein the first signal contacts are aligned in at least two rows with the first ground contacts located between the at least two rows, the first ground contacts each comprising a plurality of through-hole mounting sections extending from the first housing and a plurality of opposing cantilever arms aligned in a row in a first receiving area of the first housing.

16. An assembly as in claim 14 wherein the second signal contacts are aligned in at least two rows and, the second ground contacts each comprising a plurality of through-hole mounting sections extending from the second housing and a ground plate electrically connected to and located between the opposing arms of at least one of the first ground contacts.

* * * * *